US007260858B2

(12) United States Patent
Cushing

(10) Patent No.: US 7,260,858 B2
(45) Date of Patent: Aug. 28, 2007

(54) TODDLER BED SAFETY TOP SHEET

(76) Inventor: Cheryl J. Cushing, 14046 Pleasant Valley Rd., South Beloit, IL (US) 61080

( * ) Notice: Subject to any disclaimer, the term of this patent is extended or adjusted under 35 U.S.C. 154(b) by 0 days.

(21) Appl. No.: 11/305,955

(22) Filed: Dec. 19, 2005

(65) Prior Publication Data

US 2006/0168726 A1 Aug. 3, 2006

Related U.S. Application Data

(60) Provisional application No. 60/648,654, filed on Jan. 31, 2005.

(51) Int. Cl.
*A47G 9/02* (2006.01)

(52) U.S. Cl. ..... 5/497; 5/494

(58) Field of Classification Search ..... 5/495–497, 5/494, 485

See application file for complete search history.

(56) References Cited

U.S. PATENT DOCUMENTS

| | | | | |
|---|---|---|---|---|
| 2,066,252 A | | 12/1936 | Cohen, Jr. | |
| 2,695,414 A | * | 11/1954 | Ford et al. | 5/485 |
| 2,879,524 A | | 3/1959 | Eisen | |
| 3,605,143 A | | 9/1971 | Smith | |
| 4,035,854 A | * | 7/1977 | Pardee | 5/497 |
| 4,245,365 A | * | 1/1981 | Large | 5/496 |
| 4,308,626 A | * | 1/1982 | Weiss | 5/485 |
| 4,964,184 A | * | 10/1990 | Lewis | 5/496 |
| 5,323,501 A | | 6/1994 | Kuhangel | |
| 5,442,822 A | * | 8/1995 | Diaz | 5/497 |
| 5,465,440 A | * | 11/1995 | Heptner | 5/497 |
| 5,642,540 A | | 7/1997 | Culver et al. | |
| 6,067,677 A | | 5/2000 | Reen et al. | |
| 6,122,782 A | * | 9/2000 | Chedid | 5/495 |
| 6,725,477 B2 | * | 4/2004 | Ciaglia et al. | 5/497 |

* cited by examiner

*Primary Examiner*—Michael Trettel
(74) *Attorney, Agent, or Firm*—Reinhart Boerner Van Deuren P.C.

(57) ABSTRACT

A bed safety sheet for use on mattresses and particularly beneficial for use on a toddler bed is disclosed. The bed safety sheet includes a securement pocket at one end and side flaps along opposed sides which drape down over opposed sides of the mattress. The side flaps may include a fold to provide hospital corner looking appearance when the bed safety sheet is installed on a mattress.

20 Claims, 7 Drawing Sheets

TODDLER BED SAFETY TOP SHEET

CROSS-REFERENCE TO RELATED PATENT APPLICATIONS

This patent application claims the benefit of U.S. Provisional Patent Application No. 60/648,654, filed Jan. 31, 2005, the teachings and disclosure of which are hereby incorporated in their entireties by reference thereto.

FIELD OF THE INVENTION

The present invention generally relates to constructed fabric apparatus and more specifically relates to bed sheets.

BACKGROUND OF THE INVENTION

Bed sheets are commonly used to cover a mattress to provide a bed upon which one can sleep. It is desirable to keep a bed sheet secured on a mattress when in use for a variety of reasons. For example, it is highly desirable to keep the bed sheet on a mattress for safety as applied to crib sheets and the like to prevent the sheet from being removed from the mattress and the infant becoming entangled in the sheet, as is discussed in the present inventor's previous patent, U.S. Pat. No. 6,804,844. There is a continued desire for further improvements as it relates to mattress sheets and different securement mechanisms for different applications, which is the subject of the present invention.

BRIEF SUMMARY OF THE INVENTION

The present invention relates to a bed safety sheet for covering a mattress which comprises a fabric body having a form fitted position (e.g. an inflated or expanded position which the bed safety sheet would take when properly fitted on a mattress). In this form fitted position, the fabric body includes a generally rectangular top defining first and second sides in spaced opposition and first and second ends in spaced opposition which extend transversely between the first and second sides. A pair of flaps on the opposed sides of the rectangular top depend downward. The bed safety sheet also includes a receiving pocket disposed at one of the ends of the body which serves the purpose of securing the bed sheet over an end of the mattress. The receiving pocket includes an end portion extending downward from one end of the rectangular top and first and second side portions integrally connected to the end portion and to the first and second sides of the rectangular top. The first and second side portions extend at least partially toward the second end. The receiving pocket also includes a pocket bottom in spaced and generally parallel relation to the top. The pocket bottom is integrally connected to the first and second side portions and to the end portion.

It is an aspect of the present invention that the first and second side flaps overlap the opposed sides of the receiving pocket and may be pivotable about the first and second sides of the rectangular top.

Other aspects of the present invention, preferred implementations and preferred assembly (e.g. using different panels in order to construct and assemble a bed safety sheet) are further discussed and also claimed herein as different aspects of an invention.

Other aspects, objectives and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
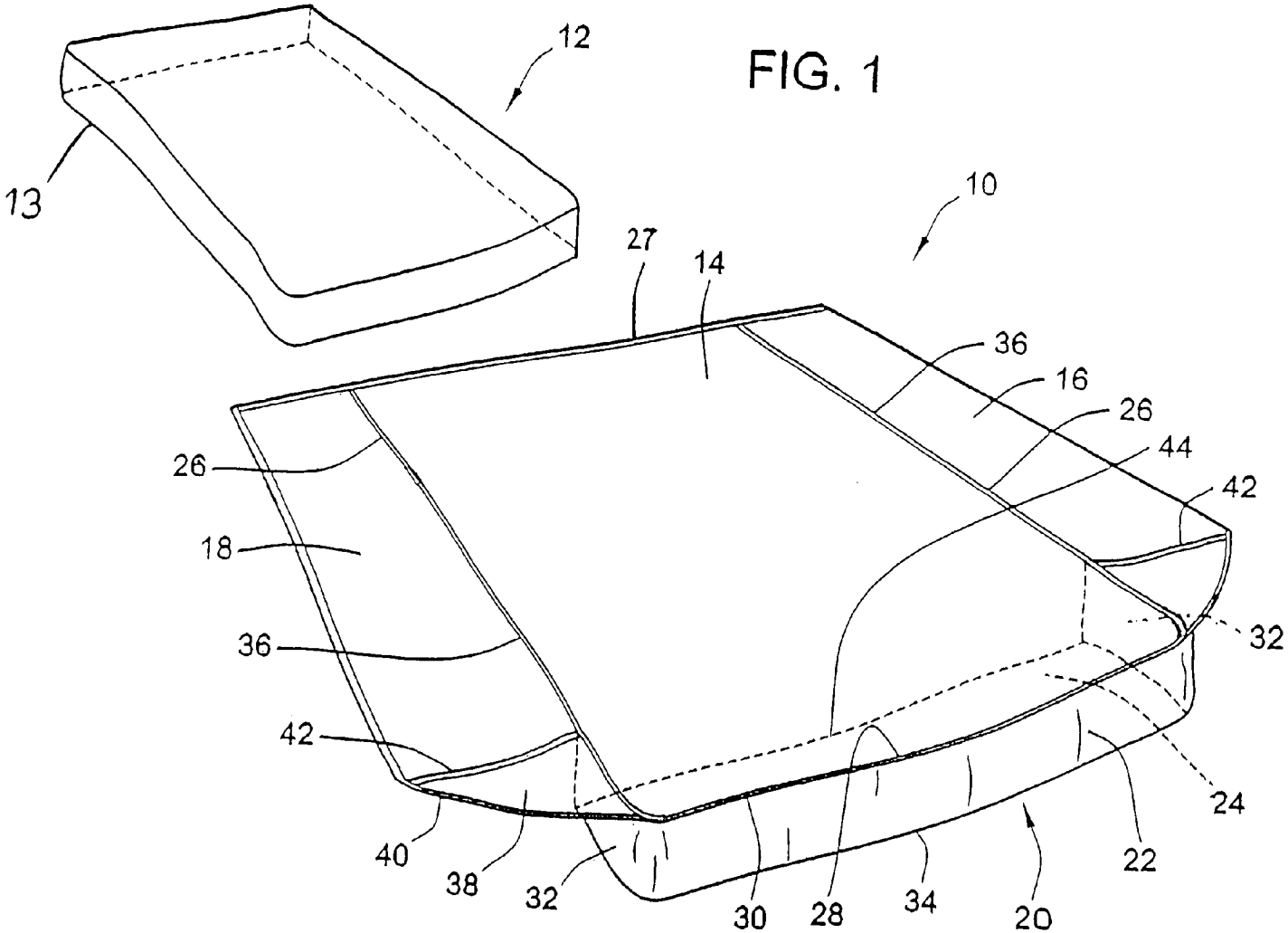
FIG. 1 is a perspective view of a bed safety sheet in a form fitted and ready to install position for a mattress, which is also shown in FIG. 1, in accordance with an embodiment of the present invention.

Turning to the figures, a bed safety sheet 10 is shown in association and for use with a mattress 12 (see FIG. 1), in accordance with an embodiment of the present invention. The preferred embodiment of the bed safety sheet generally comprises a rectangular top panel 14, a pair of side panels 16, 18, and a receiving pocket 20, which may be formed by an end panel 22 and bottom panel 24. Preferably, but not necessarily, the body of the bed safety sheet 10 is free of any elastic material or otherwise substantially free of elastic material such that the bed safety sheet can be form fitted and secured on the mattress 12 without the assistance of elastomeric material.

Figure 6:
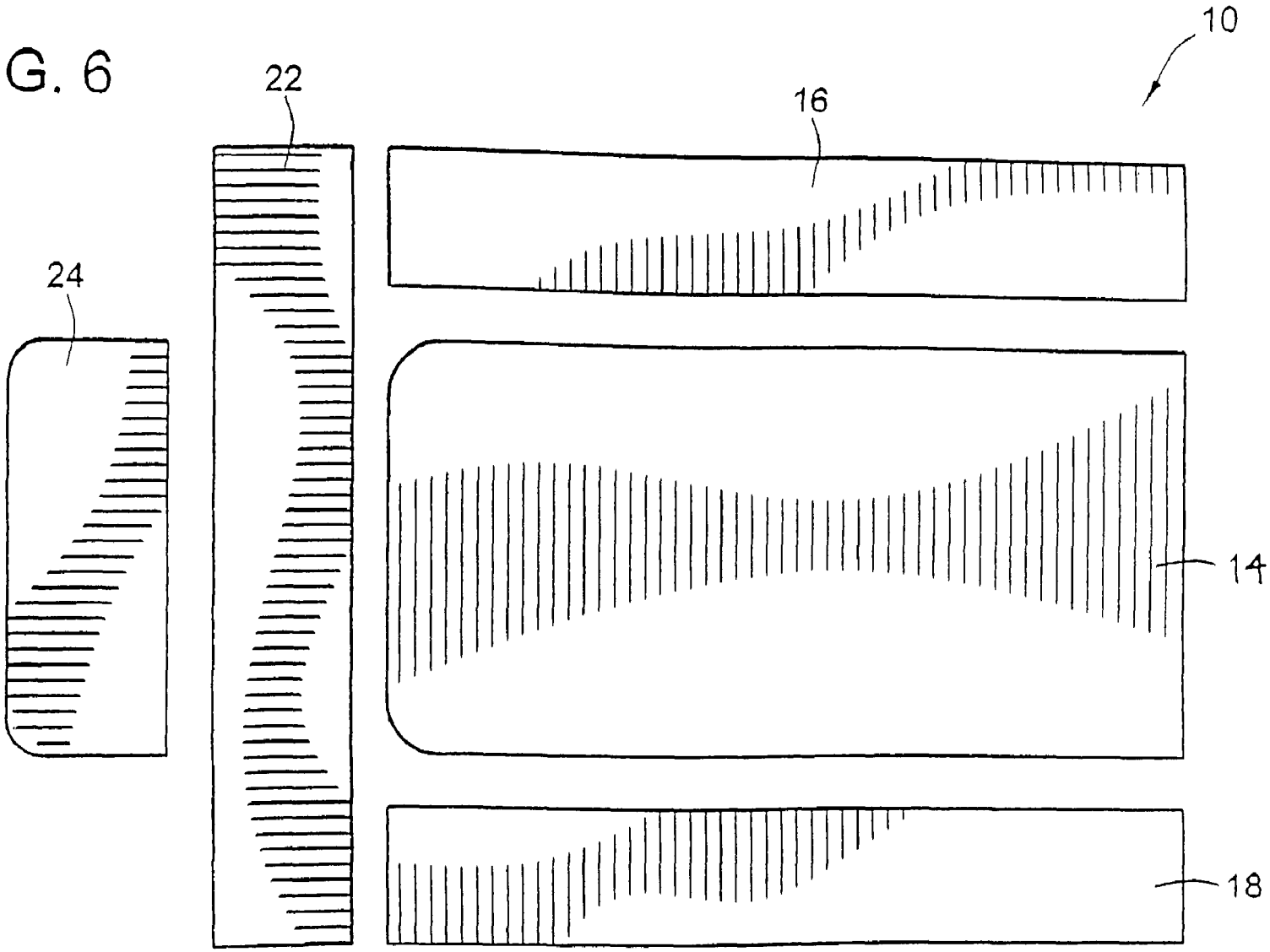
FIG. 6 is an exploded assembly view showing the different side panels which may be constructed in order to form the bed safety sheet as shown in the previous figures.

For purposes of reference, the top panel 14 which is generally rectangular and may include arcuate corners (see FIG. 6), defines opposed first and second sides 26 and opposed first and second ends 27 and 28.

The end panel 22 is sewn along end 28 of the top panel 14 along an end stitch 30. Opposed ends of the end panel 22 are wrapped around the arcuate corners of the top panel 14 with the end stitch 30 extending therearound such that the end panel 22 forms first and second side portions 32 depending downward from the opposed sides 26 of the top panel. The side portions 32 extend generally perpendicular from the end portion of the end panel 22 toward the other end of the top panel 14.

Figure 4:
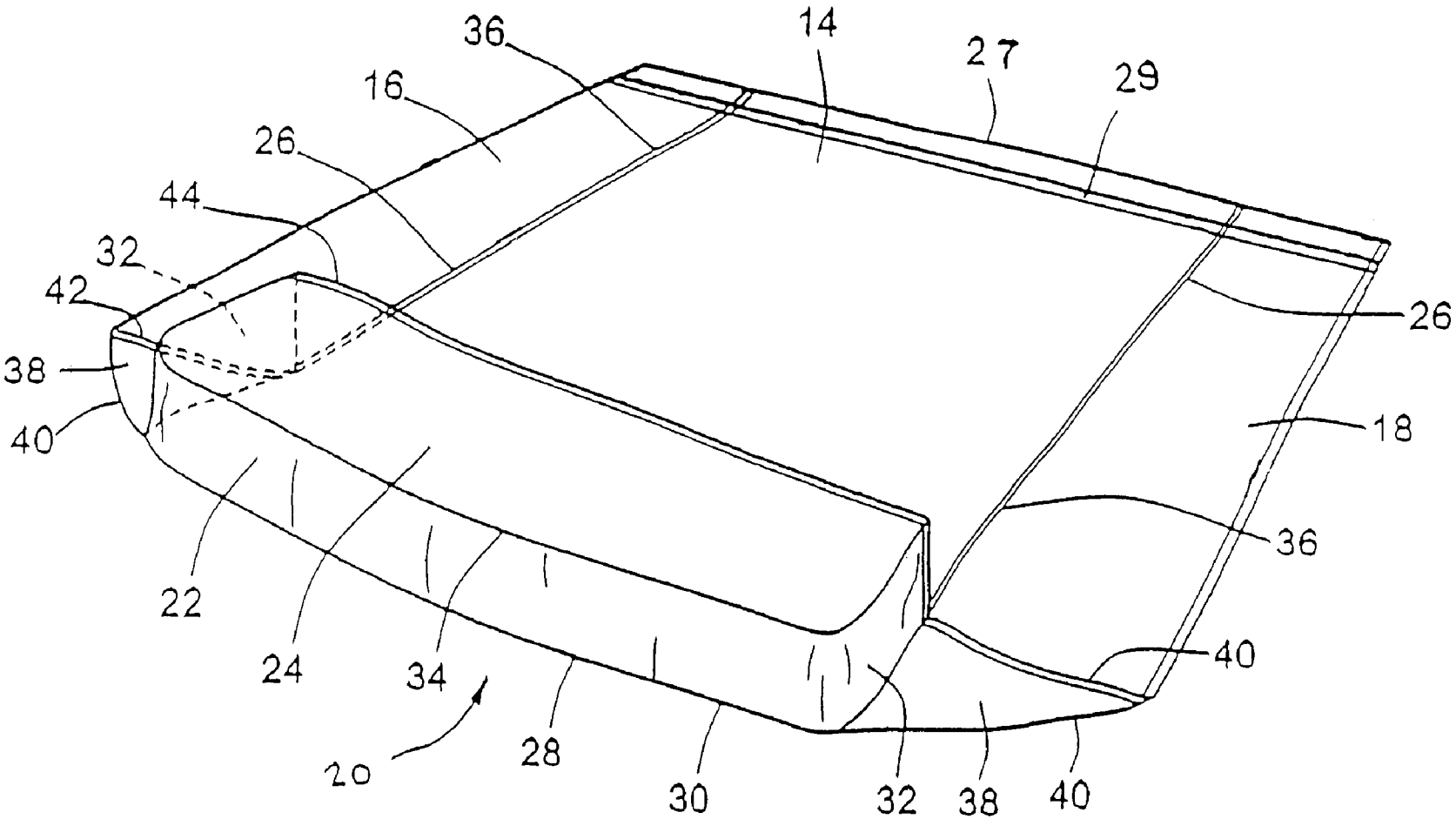
FIG. 4 is a further perspective view of the bed safety sheet as shown in FIG. 3, but taken from a bottom perspective.
Figure 5:
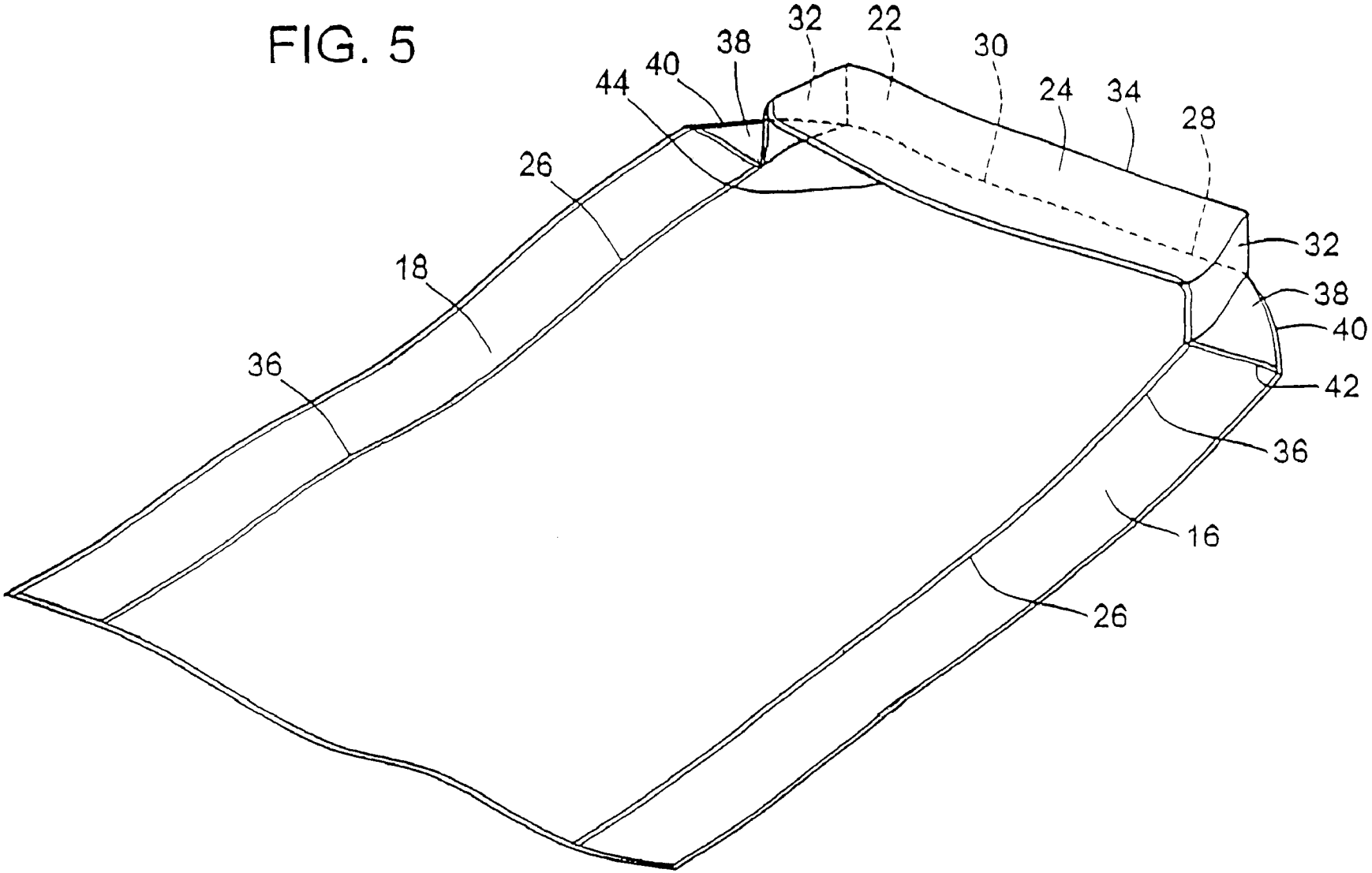
FIG. 5 is another bottom perspective view of the bed safety sheet shown in FIG. 3, but taken from a different end.

As best shown in FIG. 4, the bottom panel 24 is sewn along a bottom edge stitch 34 to the bottom edge of the end panel 22 to thereby form the receiving pocket 20. The receiving pocket 20 preferably extends partially from end 28 of the top panel 14 toward the other end 27 to provide a means for relatively easily and reliably securing the bed safety sheet 10 to a mattress and preventing it from slipping off. It is preferable, but not required, that the end panel 22 be sewn to the bottom panel 24 prior to attaching the end panel to the top panel 14.

Advantageously, only one end of a mattress needs to be manipulated in order to securely install the bed safety sheet 10 on the mattress 12 thereby providing for easier installation and removal. The other end 27 of the sheet may be a free terminating edge. The terminating edge may be formed by folding under the two side panels 16, 18 and the top panel 14 and stitching the folded portion to form a hem 29, as shown in FIG. 4.

Figure 2:
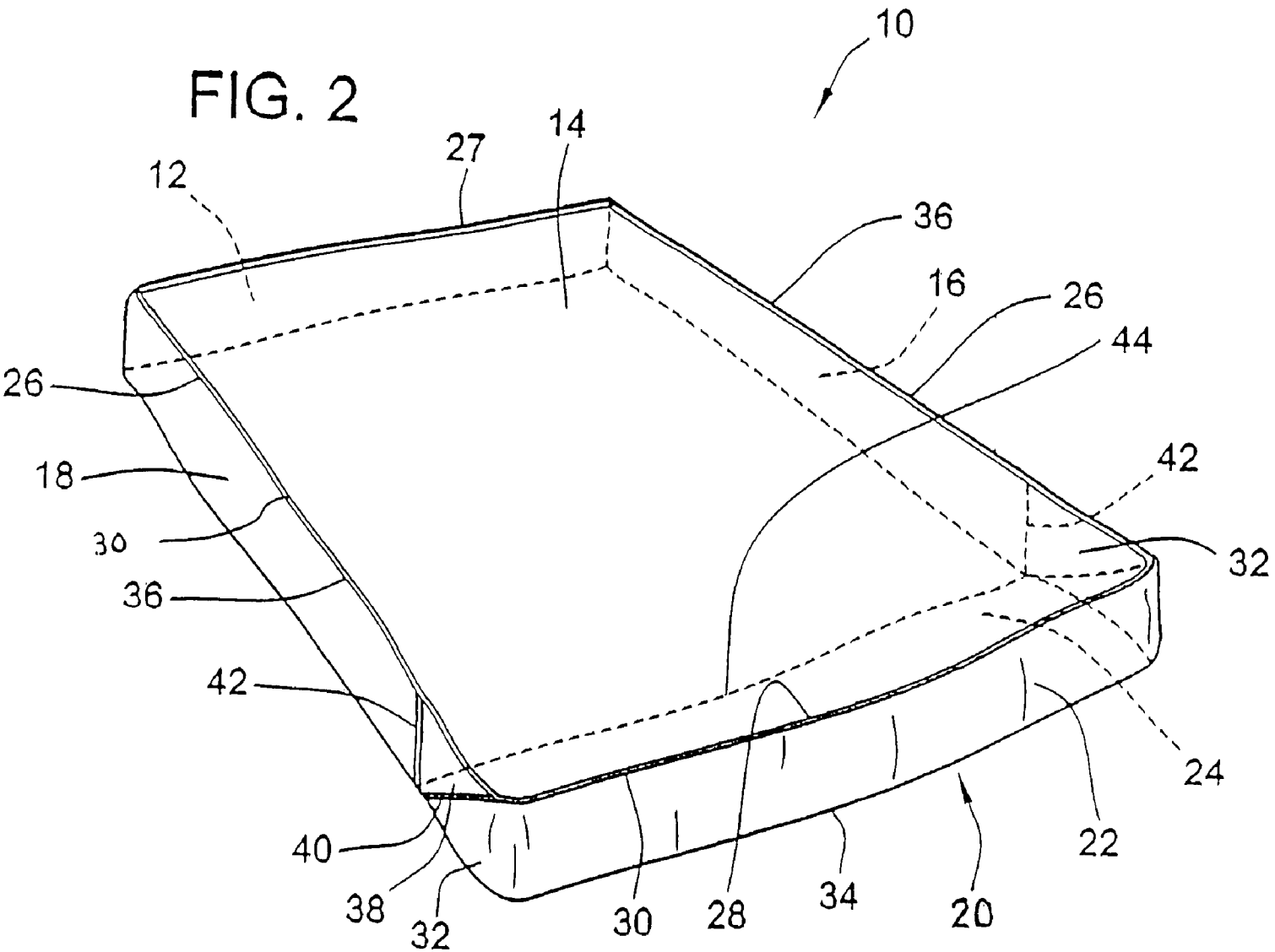
FIG. 2 is a perspective view of the bed safety sheet shown in FIG. 1 in a form fitted position and without a mattress being indicated.
Figure 3:
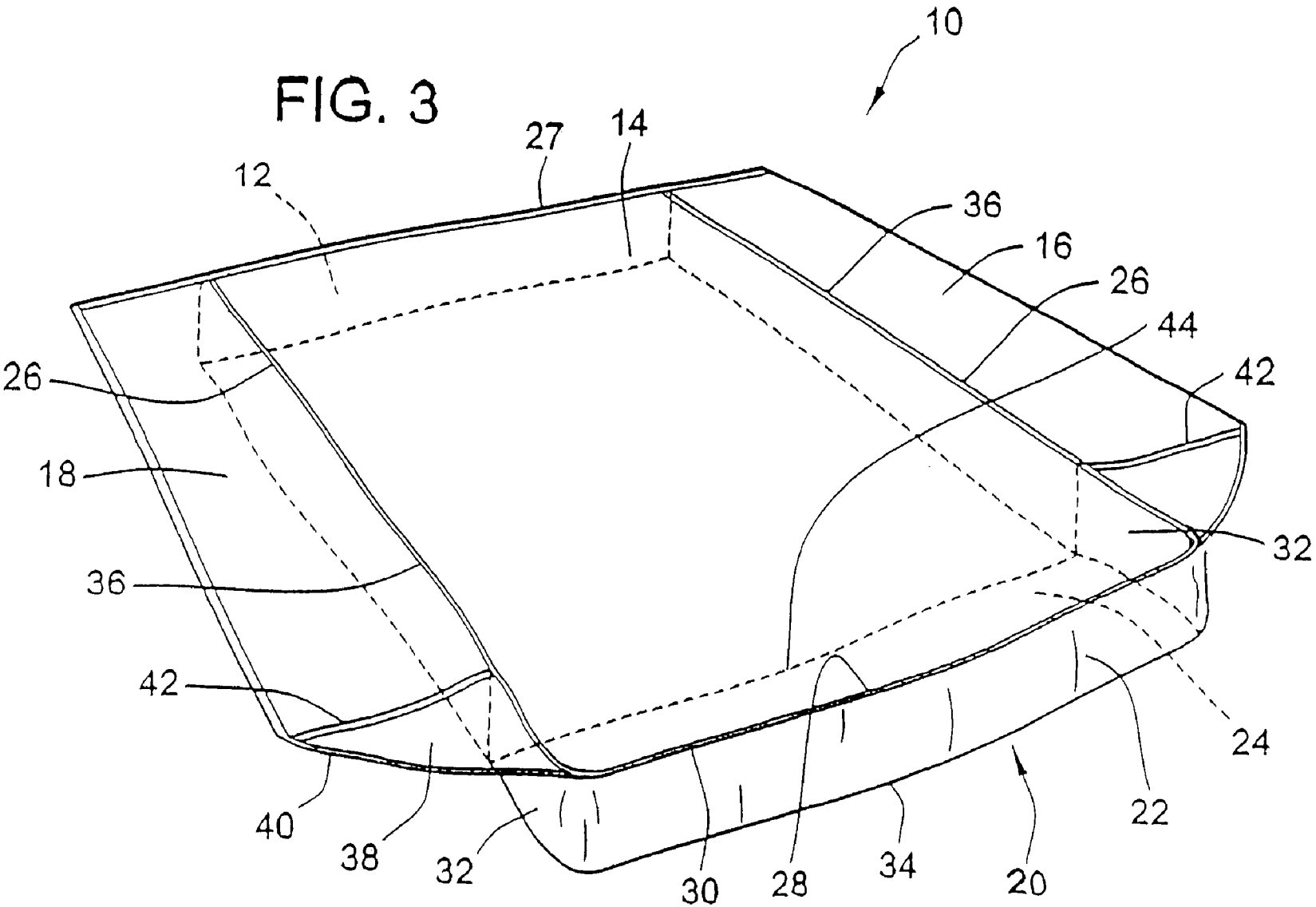
FIG. 3 is a view similar to FIG. 2, but with the side flaps raised.
Figure 7:
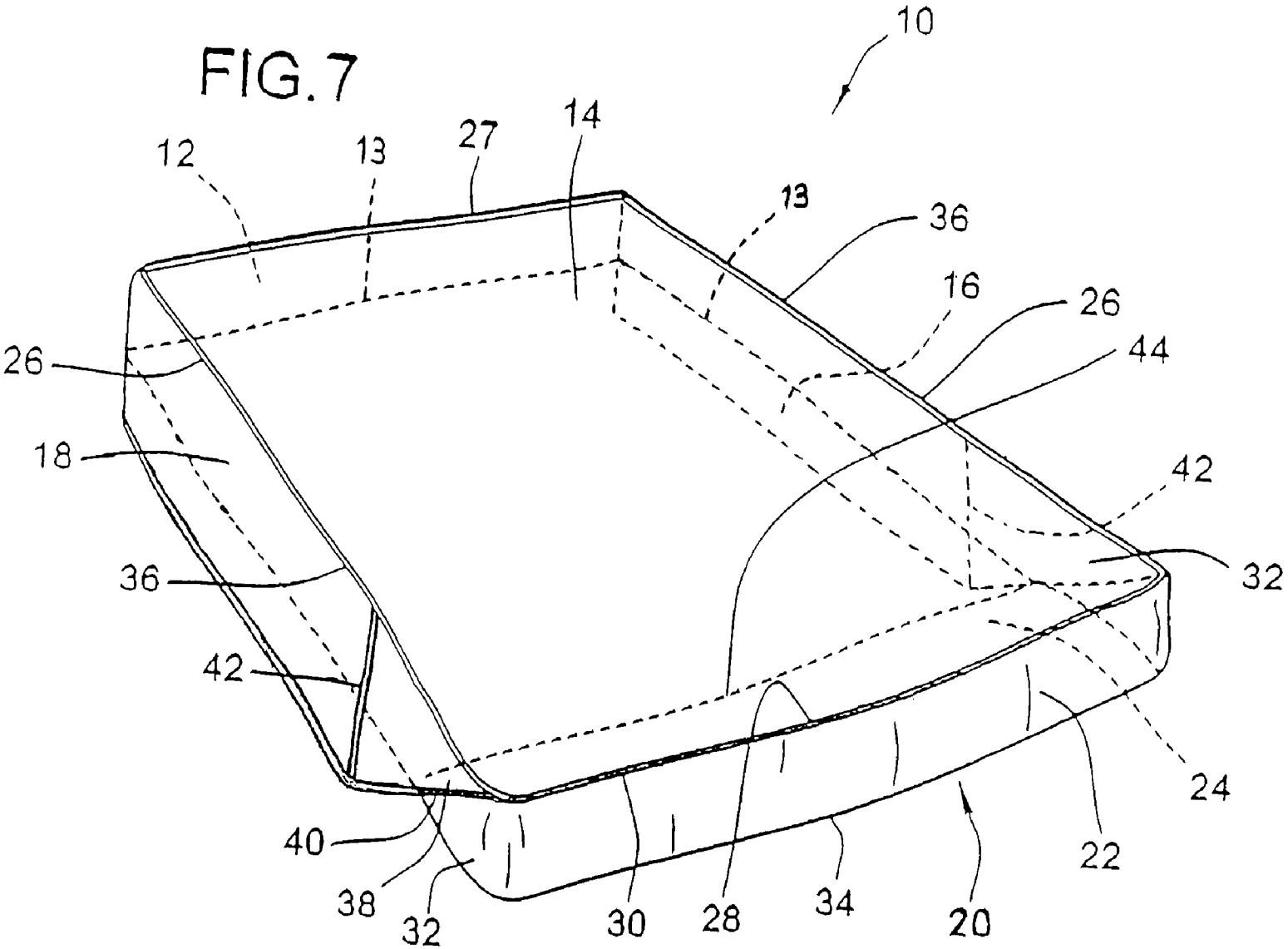
FIG. 7 is another embodiment of a bed safety sheet in accordance with the present invention, wherein the side panels of the safety sheet are sufficiently large enough to hang below the bottom edge of the mattress on which the safety sheet is secured.

Additionally, the bed safety sheet 10 includes the two side panels 16 and 18 which form side flaps along opposed sides 26 of the top panel 14. The side panels 16, 18 are sewn to opposed sides of the top panel 14 along side stitches 36. In a preferred embodiment, a single stitch combining stitch 30 and 36 connects the pair of side panels 16, 18 and the end panel 22 to the top panel 14. Particularly, the stitch 30 begins at end 27 of the top panel 14 and finishes at end 27. Furthermore, the seams for the side panels 16, 18 are top stitched to provide a finishing look The side panels 16, 18 depend downward from the top panel 14 so as to provide a means for covering the sides of the mattress 12 when installed thereon, as shown in FIG. 2. In an embodiment as shown in FIG. 7, the width of the side panels 16, 18 can be such that the side panels 16, 18 extend beyond the bottom edge 13 of the mattress 12. In this configuration, the side panels 16, 18 are known as dropsides. In a further embodiment, the side panels 16, 18 can be sufficiently wide such that a portion of the side panels 16, 18 may be folded under the mattress 12 on which the bed safety sheet is installed (see FIG. 2). The widths of the top panel 14 and side panels 16 and 18 can be such that the safety sheet 10 can be secured to beds 12 of various types and thicknesses.

It will be appreciated by one skilled in the art that the side panels 16, 18 and top panel 14 could be formed from a unitary panel of material. Particularly, the rectangular top panel 14 may be sufficiently wide such that the opposed sides 26 are spaced farther apart eliminating the need for adding separate pieces of fabric for the side panels 16, 18. It will be further appreciated by one skilled in the art that the top panel 14 may be longer in a direction from end 27 to end 28 such that the top panel 14 and the end panel 22 are formed from a single piece of material rather than two separate pieces of fabric sewn together. In this embodiment, as illustrated with reference to FIG. 1, the end stitch 30 of the previous embodiment would merely be a fold or crease rather than a stitch. Furthermore, the end stitch 34 securing the bottom panel 24 to the end panel 22, in FIG. 1, would connect the piece of fabric for the top panel 14 to the bottom panel 24. Thus, this embodiment would eliminate the need for a separate piece of fabric for the end panel 22. The side portions 32 used to form the receiving pocket 20 would then be formed from either the bottom panel 24 or the top panel 14.

Preferably, the end of each side panel 16, 18 overlap the opposed side portions 32 of the receiving pocket 20. Even more preferably, the first and second side flaps 16, 18 include a folded triangle portion 38 which is folded along a tapered crease 40, the crease could also be referred to as a fold, and sewn to a remainder of the side panel along a stitch 42 such that when the wings or flaps formed by the side panels 16 and 18 are draped downward over the sides of the mattress, the folded triangle portion 38 and tapered crease give the impression of a hospital corner type securement of the bed safety sheet 10 to the mattress when in fact a much simpler type of securement has been accomplished. Preferably, the terminating edge of each folding portion (e.g. where stitch 42 is located) substantially coincides with the terminating free edge 44 of the bottom panel 24 (see FIG. 4). It is preferred that the folded triangle portion 38 of the side panels 16, 18 are folded and sewn before the side panels 16, 18 are attached to the top panel 14.

In an embodiment, the free edges of side panels 16, 18 are one-quarter inch (¼") double hemmed. This double hemming is preferably performed prior to attaching the side panels 16, 18 to the top panel 14. It is further preferable that all free edges of the top sheet are one-quarter inch (¼") double hemmed.

As best illustrated with reference to FIG. 4, when sewing and assembling the safety bed sheet, first, the end panel 22 is stitched to the edge of the bottom panel 24 about seam 34. Particularly, the end panel 22 is wrapped around corners of the bottom panel 24 and extends perpendicularly from the bottom panel 24 creating receiving pocket 20. Then, the free edge of the ends of the end panel 22 that form the end portions 32 and the free edge 44 of the bottom panel 24 are one-quarter inch (¼") double hemmed. Next, the side panels 16, 18 are then folded to form the folded triangular portions 38, as explained previously. Next, the receiving pocket 20 is centered relative to the top panel 14 and the side panels 16, 18 are placed along the sides 26 of the top panel 14. These components, the top panel 14, side panels 16, 18, and receiving pocket 20, are then secured together by stitches 30 and 36. Preferably these stitches 30 and 36 are created by a single stitch.

An exemplary and advantageous, but not exclusive, application for the subject bed safety sheet 10 is for a toddler bed. As such, the bed safety sheet 10 may be of a pre-selected size configured for a toddler bed in which the top panel defines a rectangular dimension of between about 54 and about 55 inches long by about 28 and about 29 inches wide.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bed safety sheet for covering a mattress, comprising:

a body comprising fabric and having form fitted position with:

a generally rectangular top defining first and second sides in spaced opposition and first and second ends in spaced opposition extending transversely between the first and second sides;

the first side including a first side flap depending downward;

the second side including a second side flap depending downward;

a receiving pocket disposed at the first end, the receiving pocket including an end portion extending downward from the first end, first and second side portions integrally connected to the end portion and to the first and second sides respectively, the first and second side portions extending at least partially toward the second end, and a pocket bottom free of elastic material and in spaced and generally parallel relation to the top, the pocket bottom being integrally connected to the first and second side portions and the end portion; and wherein the body is formed from multiple panels having been secured together.

2. The bed safety sheet of claim 1, wherein the first and second side flaps overlap the first and second side portions, respectively, and wherein the first and second side flaps are pivotable about the first and second sides.

3. The bed safety sheet of claim 1, wherein each of the first and second side flaps includes a folded triangle portion at the first end, each folded triangle portion being sewn and secured to one of the sides to create a tapered lateral fold extending downward toward a bottom edge of one of the side flaps and receding in a direction toward the second end.

4. The bed safety sheet of claim 3, wherein each folded triangle portion includes a terminating edge sewn one of the side flaps.

5. The bed safety sheet of claim 4, wherein the terminating edge of each folded triangle portion substantially coincides with a terminating free edge of the pocket bottom.

6. The bed safety sheet of claim 1, wherein the bed safety sheet is substantially free of elastomeric material such that the bed safety sheet can be formed fitted and secured on the mattress without the assistance of elastomeric material.

7. The bed safety sheet of claim 1, wherein the bed safety sheet is of a preselected size for a toddler bed, wherein the top panel defines a generally rectangular dimension of between about 54 and about 55 inches long by about 28 and about 29 inches wide.

8. The bed safety sheet of claim 1, wherein the second end defines a terminating free edge.

9. The bed safety sheet of claim 8, wherein the terminating free edge is defined by folding under the second end and stitching the fold to form a hem.

10. A bed safety sheet for covering a mattress, comprising:

a body comprising fabric and having form fitted position with:

a generally rectangular top defining first and second sides in spaced opposition and first and second ends in spaced opposition extending transversely between the first and second sides;

the first side including a first side flap depending downward;

the second side including a second side flap depending downward;

a receiving pocket disposed at the first end, the receiving pocket including an end portion extending downward from the first end, first and second side portions integrally connected to the end portion and to the first and second sides respectively, the first and second side portions extending at least partially toward the second end, and a pocket bottom in spaced and generally parallel relation to the top, the pocket bottom being integrally connected to the first and second side portions and the end portion; and wherein the body comprises multiple panels sewn together, including:

a rectangular top panel for the rectangular top;

a first side panel for the first side, sewn along a first side stitch to a first side edge of the rectangular top panel;

a second side panel for the second side, sewn along a second side stitch to a first side edge of the rectangular top panel;

an end panel for the end portion and the first end, first and second side portions, the end panel having a top edge sewn along an end stitch to a first end edge of the rectangular top panel and partially along the first and second side edges; and a bottom panel for the pocket bottom sewn along a pocket stitch to a bottom edge of the end panel.

11. The bed safety sheet of claim 10, wherein the first and second side flaps overlap the first and second side portions, respectively, and wherein the first and second side flaps are pivotable about the first and second sides.

12. The bed safety sheet of claim 11, wherein each of the first and second side flaps includes a folded triangle portion at the first end, each folded triangle portion being sewn and secured to one of the sides to create a tapered lateral fold extending downward toward a bottom edge of one of the side flaps and receding in a direction toward the second end.

13. The bed safety sheet of claim 12, wherein each folded triangle portion includes a terminating edge sewn to one of the side flaps.

14. The bed safety sheet of claim 13, wherein the terminating edge of each folded triangle portion substantially coincides with a terminating free edge of the bottom panel.

15. A bed safety sheet for covering a mattress, comprising:

a body comprising fabric and having form fitted position with:

a generally rectangular top defining first and second sides in spaced opposition and first and second ends in spaced opposition extending transversely between the first and second sides;

the first side including a first side flap depending downward;

the second side including a second side flap depending downward;

a receiving pocket disposed at the first end, the receiving pocket including an end portion extending downward from the first end, first and second side portions integrally connected to the end portion and to the first and second sides respectively, the first and second side portions extending at least partially toward the second end, and a pocket bottom in spaced and generally parallel relation to the top, the pocket bottom being integrally connected to the first and second side portions and the end portion; and wherein each side portion includes a top edge extending along the sides of the rectangular top and a bottom edge along the pocket bottom, wherein the top edge of each side portion is joined to the rectangular top by a sewn seam.

16. The bed safety sheet of claim 15, wherein the sewn seam intersects the top rectangular top at a sewn seam intersection wherein the sewn seam intersection is disposed adjacent to the top of the mattress in spaced relation above the bottom of the mattress.

17. The bed safety sheet of claim 15 wherein the side portions are generally rectangular.

18. The bed safety sheet of claim 15, wherein each of the first and second side flaps includes a folded triangle portion at the first end, the sewn seam attaching each folded triangle portion being sewn to one of the side flaps.

19. The bed safety sheet of claim 18, wherein each folded triangle portion includes a terminating edge sewn one of the side flaps.

20. The bed safety sheet of claim 15, wherein the bed safety sheet is free of elastic.

* * * * *